United States Patent [19]

Bleke

[11] Patent Number: 4,470,215

[45] Date of Patent: Sep. 11, 1984

[54] ANTI-CORROSIVE SACRIFICIAL ANODE ATTACHMENT FOR FIREARMS

[76] Inventor: James Bleke, 3501 Rue Nichole New Orleans, La. 70114

[21] Appl. No.: 395,132

[22] Filed: Jul. 6, 1982

[51] Int. Cl.[3] ..... F41C 27/00

[52] U.S. Cl. ..... 42/1 N

[58] Field of Search ..... 42/1 N, 1 R

[56] References Cited

U.S. PATENT DOCUMENTS

| | | | |
|---|---|---|---|
| 540,748 | 6/1895 | Layton | 42/1 N |
| 2,406,993 | 9/1946 | Chandler | 42/1 N |
| 2,558,792 | 7/1951 | Snowden | 42/1 N |
| 3,593,451 | 7/1971 | McDonnell | 42/1 N |
| 4,054,002 | 10/1977 | Latona, Jr. | 42/1 N |

*Primary Examiner*—Charles T. Jordan

*Attorney, Agent, or Firm*—Thomas S. Keaty

[57] ABSTRACT

An anti-corrosive sacrificial anodal attachment is provided for substantially reducing corrosion of gun barrels, breeches, internal mechanisms, and any other functional or decorative iron based member of a firearm. The attachment is comprised of a plurality of rib-like sacrificial anodes made of a material more active in the galvanic series than iron. The ribs are mounted on a flexible strip having velcro fasteners on both sides. The velcro fasteners are disposed in such fashion that the anodes may be wrapped in surface engaging contact with a gun barrel, and the velcro fasteners engage one another to maintain the anodes in close engagement with the surface of the gun barrel, thereby providing cathodic protection for the barrel. In other embodiments, a biased wire spring or small magnets embedded in the rib are used to maintain the ribs in engaging contact with the surface of the firearm.

16 Claims, 7 Drawing Figures

ANTI-CORROSIVE SACRIFICIAL ANODE ATTACHMENT FOR FIREARMS

BACKGROUND OF THE INVENTION

1. Field of the Invention

The present invention is a device for preventing corrosion of firearms. More particularly, the invention relates to the use of sacrificial anodes comprising a material more active in the galvanic series than iron based metals. The sacrificial annode, when attached to the outer surface of a gun barrel, or the like, utilizes the principle of cathodic protection to substantially reduce corrosion of the gun barrel, breeches, and internal mechanisms.

2. Description of the Prior Art

A serious problem that faces hunters and other outdoor users of firearms is the inherent difficulty of preventing rusting of the gun barrel and internal parts of the gun mechanism due to exposure to moisture.

An early attempt to solve this problem is found in U.S. Pat. No. 540,748 issued to Layton. This device comprised a plug adapted for placement in the outer end of a gun barrel. The plug was filled with an absorbent material for gathering the moisture in the gun barrel to itself, thereby preventing oxidation or corrosion of the metal forming the barrel.

U.S. Pat. No. 2,406,993 issued to Chandler discloses another plug adapted for placement in the outer end of a gun barrel, this plug again being filled with dehydrating material for preventing corrosion of the internal parts of the weapon.

U.S. Pat. No. 4,054,002 issued to Latona also discloses an elongated tubular dessicating device adapted for placement in the outer end of the gun barrel. The dessicating plug further is provided with a magnetic head for holding the plug securely inside the barrel.

The prior art is replete with caps or plugs for placement over the open end of the barrel to prevent plugging with snow, dirt, or contamination with water. Examples of such disclosures include U.S. Pat. No. 2,558,792; U.S. Pat. No. 3,063,184; U.S. Pat. No. 3,593,451; U.S. Pat. No. 3,354,569.

GENERAL DISCUSSION OF THE PRESENT INVENTION

The preferred embodiment of the present invention provides a device for preventing corrosion of the barrel, breech, internal mechanism, and any other steel member directly used as a functional or decorative component of a gun. A series of sacrificial anodes, comprised of a material more active in the galvanic series than iron based metals, is securely attached to the outer surface of the barrel. The sacrificial anodes are penetrated by the electrolytic corrosive medium (i.e., moisture) more readily than the iron based gun barrel, and corrosion of the anodes therefore proceeds much more rapidly than corrosion of the metallic barrel.

The sacrificial anodes, as mentioned above, are comprised of a material more active in the galvanic series than iron based metals. Examples of the more galvanically active metals are magnesium, zinc and aluminum. The preferred embodiment of the present invention employs a magnesium alloy containing 5.8 to 7.2% aluminum, a minimum of 0.15% manganese, 0.4 to 1.5% zinc, a maximum of 0.05% silicone, a maximum of 0.005% iron and a maximum of 0.005% nickel. This combination provides a very galvanically active material that corrodes much more quickly than the iron based barrel, thereby substantially reducing the corrosion rate of the barrel, breech, and internal mechanism.

The sacrificial anodes are supported in rib-like fashion by a flexible spine made of velcro or other suitable material. The spine is constructed in such a fashion that the velcro strip can hold the anodes firmly engaged around the surface of the gun barrel. Other embodiments provide magnets in the anodes or a spring biased spine for similarly maintaining the anodal ribs in contact with the surface of the gun barrel. The embodiment employing magnetic fastening means is especially versatile because the individual anodes can be placed at a number of separate attachment points along the length of the barrel. In contrast, the other fastening means require the anodes be placed in a substantially circular arrangement at a single point on the barrel. Both embodiments are nonetheless quite effective in protecting the weapon from corrosion.

It is an object of the present invention to provide a sacrificial anode, operating on the principle of cathodic protection, for reducing the corrosion rate on gun barrels, breeches, internal mechanisms, and any other steel member directly used as a functional or decorative component of a gun.

It is still a further object of the present invention to provide a sacrificial anode that will not interfere with the discharging of a firearm if the anode is inadvertently not removed before the firearm is used.

BRIEF DESCRIPTION OF THE DRAWINGS

For a further understanding of the nature and objects of the present invention, reference should be had to the following detailed description taken in conjunction with the accompanying drawings, in which like parts are given like reference numerals and wherein.

DETAILED DESCRIPTION OF THE PREFERRED EMBODIMENT

Figure 5:
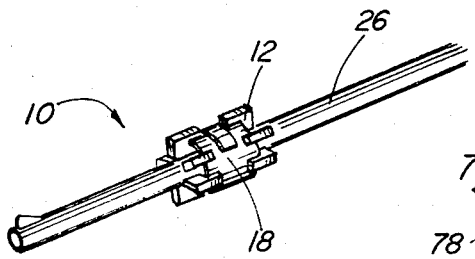
FIG. 5 is a view of the device shown in FIG. 1 after the device has been securely attached to the gun barrel for preventing corrosion.

FIGS. 1, 2, 3 and 5 best show the preferred embodiment of the anti-corrosive sacrificial anodal attachment 10. The attachment 10 is comprised of a plurality of ribs 12 which contain a recess 14 on one side, and a series of indentations 16 on the other side of rib 12.

The rib 12 is comprised of any material more active in the galvanic series than iron based metals, examples of such galvanically active materials being magnesium, zinc and aluminum. An especially galvanically active alloy, suitable for use in the present invention, is a magnesium alloy containing 5.8 to 7.2% aluminum, a minimum of 0.15% manganese, 0.4 to 1.5% zinc, a maximum of 0.05% silicone, a maximum of 0.005% iron and a maximum of 0.005% nickel.

Ribs 12 are mounted on strip 18 having a first velcro side 20, and extension 21 as a second velcro side 22. The ribs 12 are mounted on the strip 18 by inserting the strip 18 through the flanged portions 24 or recess 14. First side 20 of strip 18 contains female velcro fasteners, and side 22 contains male velcro fasteners.

Figure 3:
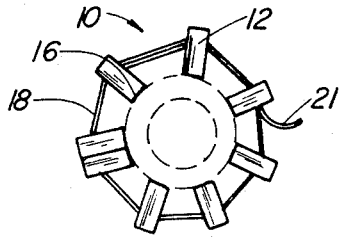
FIG. 3 is a side view of a second embodiment of the device shown in FIGS. 1 and 2 after it has been secured to the gun barrel.

In operation, the attachment 10 is placed around a gun barrel 26 (see FIGS. 3 and 5). Ribs 12 are maintained in snug surface engaging contact with barrel 26 by wrapping ribs 12 around barrel 26 with indentations 16 engaging the surface of barrel 26 and side 20 facing outwardly from barrel 26. Side 22 of extension 21 overlaps side 20 of strip 18, the velcro fasteners in sides 20, 22 overlapping in interengaging contact to hold attachment 10 snugly around barrel 26.

Figure 4:
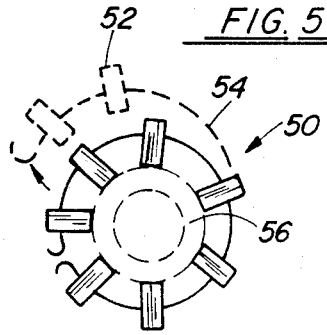
FIG. 4 is a side view of a second embodiment of the invention wherein a spring biased spine maintains the anodes in surface engaging contact with the gun barrel.

In a second embodiment of the invention disclosed herein (FIG. 4), an attachment 50 is comprised of ribs 52, similar to ribs 12 above, mounted on a flexible spine 54. Spine 54 is comprised of a biased wire for holding ribs 52 in snug engagement with gun barrel 56.

Figure 6:
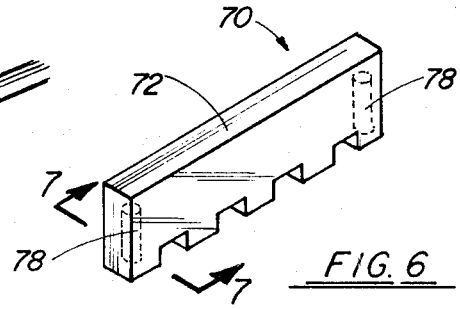
FIG. 6 is a perspective view of a third embodiment having a magnet disposed inside the anode for maintaining the device in surface engaging contact with the gun barrel, the magnets being shown in phantom lines.
Figure 7:
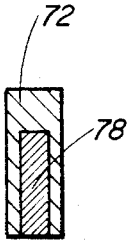
FIG. 7 is a cross-sectional view along line 6—6 of FIG. 6.
Figure 2:
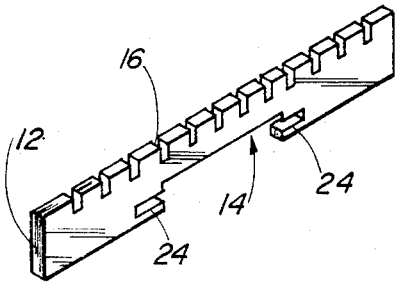
FIG. 2 is a perspective view of one rib of the sacrificial anodal attachment.
Figure 1:
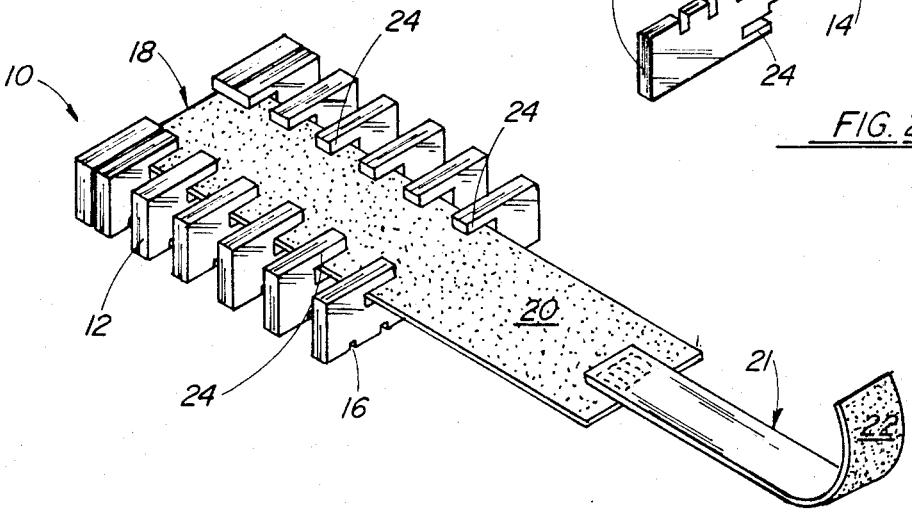
FIG. 1 is a perspective view of the preferred embodiment of the anodal attachment of the present invention before it is placed in surface engaging contact with the gun barrel.

In a third embodiment of the present invention shown in FIGS. 6 and 7, attachment 70, comprised at rib 72 is held in firm surface engaging contact with a gun barrel (not shown) by means of magnets 78 which are contained within ribs 72 near the surface engaging portion of ribs 72. An advantage of this embodiment is the capability of placing the anodes at separate locations along the barrel, instead of concentrically as required by the other embodiments.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not in a limiting sense.

What is claimed as invention is:

1. An anticorrosive sacrificial anode attachment for firearms comprising:

a. a plurality of anodal elements composed of a material more active in the galvanic series than iron based metals;

b. attachment means for disposing said elements in surface engaging contact with said firearm.

2. The device of claim 1, wherein said attachment means comprises an elongated, flexible spine having said elements mounted thereon.

3. The device of claim 2, wherein said elements are composed of a magnesium alloy.

4. The device of claim 3, wherein said elements are composed of a magnesium alloy containing 5.8 to 7.2% aluminum, a minimum of 0.15% manganese, 0.4 to 1.5% zinc, a maximum of 0.05% silicone, a maximum of 0.005% iron and a maximum of 0.005% nickel.

5. The device of claim 2, wherein said spine is comprised of a strip having male velcro fasteners on a first side and female velcro fasteners on a second side, said first and second sides being disposed in overlapping attached relationship for retaining said elements in surface engaging contact with said firearm.

6. The device of claim 2, wherein said spine is comprised of a first strip having said ribs mounted thereon, and a second lengthwise extension strip, said second strip being of narrower width than said first strip, said first strip having female velcro fasteners contained on one surface thereof and said second strip having male velcro fasteners contained on one surface thereof, said surfaces of said first and second strips being disposed in overlapping attached relationship, thereby retaining said elements in surface engaging contact with said firearm.

7. The device of claim 6, wherein said elements are rib-like members disposed transversely to said spine, said ribs being provided with T-shaped recesses for receiving said first strip therein, said T-shaped recesses providing an exposed rectangular area of said first strip for receiving said second strip in overlapping attached relationship.

8. The device of claim 7, wherein said rib-like members are disposed in spaced, parallel relationship.

9. The device of claim 3, wherein said attachment means further comprises magnets contained within said elements for retaining said elements in surface engaging contact with said firearm.

10. The device of claim 9, wherein said elements are disposed at non-concentric positions on a barrel.

11. The device of claim 3, wherein said spine comprises a biased wire for retaining said elements in surface engaging contact with said firearm.

12. An anticorrosive sacrificial anode attachment for firearms comprising:

a. an enlongated, felxible spine b. a plurality of anodal ribs having T-shaped recesses contained therein for receiving said strip in rib supporting relationship, c. said ribs being composed of a magnesium alloy containing 5.8 to 7.2% aluminum, a minimum of 0.15% maganese, 0.4 to 1.5% zinc, a maximum of 0.05% silicone, a maximum of 0.005% iron and a maximum of 0.005% nickel d. attachment means for retaining said ribs in surface engaging contact with said firearm.

13. The device of claim 12, wherein said attachment means comprises the spine having a first strip upon which said ribs are mounted, and a second lengthwise extension strip, said second strip being of narrower width than said first strip, said first strip having female velcro fasteners contained on one surface thereof and said second strip having male velcro fasteners contained on one surface thereof, said surfaces of said first and second strips being disposed in overlapping attached relationship, thereby retaining said elements in surface engaging contact with said firearm.

14. The device of claim 12, wherein said attachment means comprises a wire spine biased for firearm engaging contact.

15. The device of claim 12, wherein said attachment means comprises nagnets contained within said elements.

16. The device of claim 15, wherein said elements are disposed at non-concentric positions on a barrel.

* * * * *